US005452960A

United States Patent [19]

Kuhlenschmidt

[11] Patent Number: 5,452,960

[45] Date of Patent: Sep. 26, 1995

[54] CHILDREN'S COMPUTER KEYBOARD

[76] Inventor: Richard E. Kuhlenschmidt, 620 Via De La Pez, Pacific Palisades, Calif. 90272

[21] Appl. No.: 329,899

[22] Filed: Oct. 27, 1994

[51] Int. Cl.[6] ..... B41J 5/10

[52] U.S. Cl. ..... 400/487; 400/489; 345/168; 341/22

[58] Field of Search ..... 400/485, 486, 400/487, 489; 345/157, 160, 168; 341/21, 22, 24

[56] References Cited

U.S. PATENT DOCUMENTS 4,940,346 7/1990 Lijenquist ..... 400/486
4,974,183 11/1990 Miller ..... 400/489
5,143,462 9/1992 Klauber ..... 400/486

OTHER PUBLICATIONS

Radio Shack Catalog, pp. 9 and 157.

*Primary Examiner*—Edgar S. Burr
*Assistant Examiner*—Steven S. Kelley

[57] ABSTRACT

A children's computer keyboard includes enlarged keys that are color-coded according to their functions, and a four directional arrow-key pad of unique configuration. Characters on the keys of the children's computer keyboard are also enlarged for improved visibility. The enlarged keys provide wider top surface dimension between keys which provides each key with a larger error free area than a standard sized keyboard thus more tolerant for human error. A keyboard connector/extension cord with separable parts is provided for easy keyboard changing.

5 Claims, 7 Drawing Sheets

20

CHILDREN'S COMPUTER KEYBOARD

FIELD OF THE INVENTION

The present invention-is generally related to a typing device, and more specifically, it is a children's computer keyboard apparatus.

BACKGROUND OF THE INVENTION

The computer is not only a tool for adults or students anymore. Because of the availability of personal computers and more affordable pricing, the computer is now getting very popular for home use. As a result, it has become more accessible to children of very young age. Most of the children's first contact with a computer is through playing computer games. Parents also educate their children through educational programs running on a computer. Because of their young age and not being familiar with the computer keyboard, young children often find themselves spending most of their time locating the keys on the computer keyboard or making corrections for the wrong characters they typed in. As a result, the children may feel frustrated and, eventually, may give up the idea of learning through playing with a computer. Thus, the computer keyboard designed for adults, and not intended for young children to use, may impede children's interest in learning through the computer games or programs.

Physically disabled individuals may have difficulty coordinating their fingers with what they see, or may have mobility difficulty with their limbs. Because of the size of the keys on a standard sized computer keyboard, they may have great difficulties in hitting the correct keys on a standard sized computer keyboard.

Those individuals with disabilities to communicate, verbally or written, may find it easier to communicate through typing on a computer or typewriter. Because of their disabilities, however, they may have difficulties typing on a computer keyboard with standard sized keys.

The traditional keyboard is not intended for minority group of users such as young children or physically disabled individuals. Young children tend to have problem coordinating their fingers and eyes. Physically disabled individuals may have difficulties mobilizing their limbs and fingers. They may also have problem controlling their body movements. Besides, those young children who use computers may not be familiar with the locations of the keys on a traditional QWERTY keyboard, because they are designed for typing efficiencies, and not for young children. This unfamiliarity with the locations of the keys may become an obstacle to the children in using the keyboard and, therefore, impede the children's desire to learn.

Computer keyboard manufacturers realize the frustration that young children face with the traditional computer keyboard, and try to overcome the problem. Several types of computer keyboards for children are now available on the market. Each of them has some advantages and disadvantages. Some of them are targeted toward children users only and are not suitable for general purpose use; and others may have a more attractive appearance to children users but do not have features to help those children in learning to use a computer.

Comfy Interactive Movies Ltd., an Israeli company in Tel Aviv, developed a computer keyboard for young children, the ComfyKeyboard. The ComfyKeyboard has a set of large, colorful, or labeled with pictures, keys. The ComfyKeyboard can only be used with programs developed specifically for the keyboard, for instance, ComfyLand, because it has only twenty-one keys. ComfyLand is a series of animated cartoons. By pressing one of the twenty-one keys on the keyboard, children can change the colors or musical sounds in the cartoon. The ComfyKeyboard is not made to use for a word processor or spreadsheet. Therefore, the usage of the ComfyKeyboard is very limited.

KidBoard, Inc. developed a KidBoard keyboard. KidBoard has color-coded keys with pictures. KidBoard also has a decorative frame which looks like a smiling face. KidBoard has the standard QWERTY keyboard layout and the standard sized keys.

Jerry Wagstrom of Huntersville, N.C., developed a Kid Keys keyboard for children. The Kid Keys has oversized, colorful keys arranged in alphabetical order. The color arrangement in Kid Keys is that vowel keys are yellow, "R" key is red, "Y" key is yellow, "B" key is blue, and "G" key is green, and the rest of the keys are grey.

The Kid Keys' arrangement of keys in alphabetical order may help those children who first learn to use a computer and are not familiar with the location of the keys. However, when they grow up to the age to learn to type, they may have a problem adjusting themselves in learning the layout of a QWERTY keyboard on a standard keyboard.

SUMMARY OF THE INVENTION

The present invention is a children's computer keyboard with enlarged keys intended for young children or physically disabled users. With the enlarged keys on the keyboard, the children will have a higher rate of success in hitting the keys they intend to hit and thus, inducing their desire to learn through playing with computers.

The larger keys on the present invention provide a larger surface space for characters to be put on them. It is easier for young children to locate the keys with larger characters on them. Therefore, it is one aspect of the present invention to provide not only larger keys but also larger characters on the keys.

The keys are color-coded according to their function. The alphabet keys have the same color, the number keys another color, the function keys have a third color, the arrow keys are coded in a fourth color, the punctuation mark keys have a fifth color, etc. The color-coded-key arrangement helps children in grouping the keys according to their function.

The keyboard of the present invention has the identical layout of a standard QWERTY keyboard. With the larger keys and larger characters, the children can identify the location of each key much easier and much faster. After using the keyboard of the present invention for some time, the children will be familiar with the relative position of the keys. When the children are older and already familiar with the relative position of the keys, they will have a much easier time switching to the standard QWERTY keyboard. They don't have to relearn the standard QWERTY keyboard layout.

It is another aspect of the present invention to provide a square shaped arrow-key pad. The arrow-key pad comprises four right-angled isosceles triangular shaped arrow keys. The arrangement of the arrow-key pad makes it easy for one person to operate the keys effectively with three fingers.

It is yet another aspect of the present invention to provide a separable extension cord connecting between the keyboard and the computer system, which makes it easy to change keyboards.

BRIEF DESCRIPTION OF THE DRAWING

The invention is disclosed in the specification and the attached drawings wherein.

DETAILED DESCRIPTION OF THE INVENTION

Because the standard sized computer cannot fulfill the needs of young children users, the usages of other keyboards made for young children are also limited to children users only. None of the keyboards now available are suitable for general public to use. What is needed is a computer keyboard which has bigger keys that is easier for the children to hit the correct keys; bigger characters on the keys that are easier for the children to identify and locate the keys; color-coded keys for separating the different functions between different groups of keys; and color-coded keys to help children in learning the relationship and differences between the keys. When using a keyboard with the above features, young children can enjoy learning more and will have more time learning. The children will not be wasting their time in finding the keys or correcting their mistakes.

Figure 1:
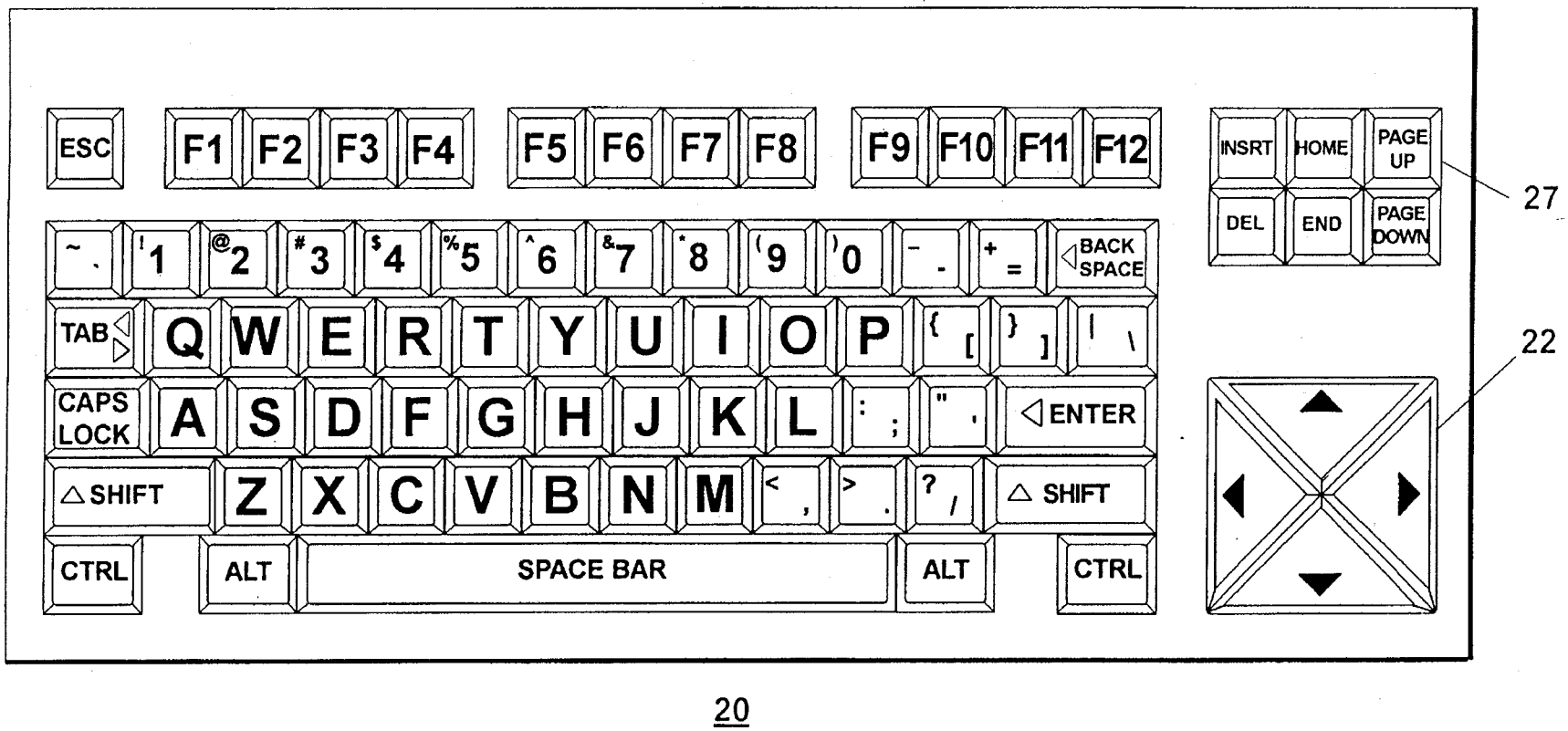
FIG. 1 is the children's computer keyboard face.
Figure 2:
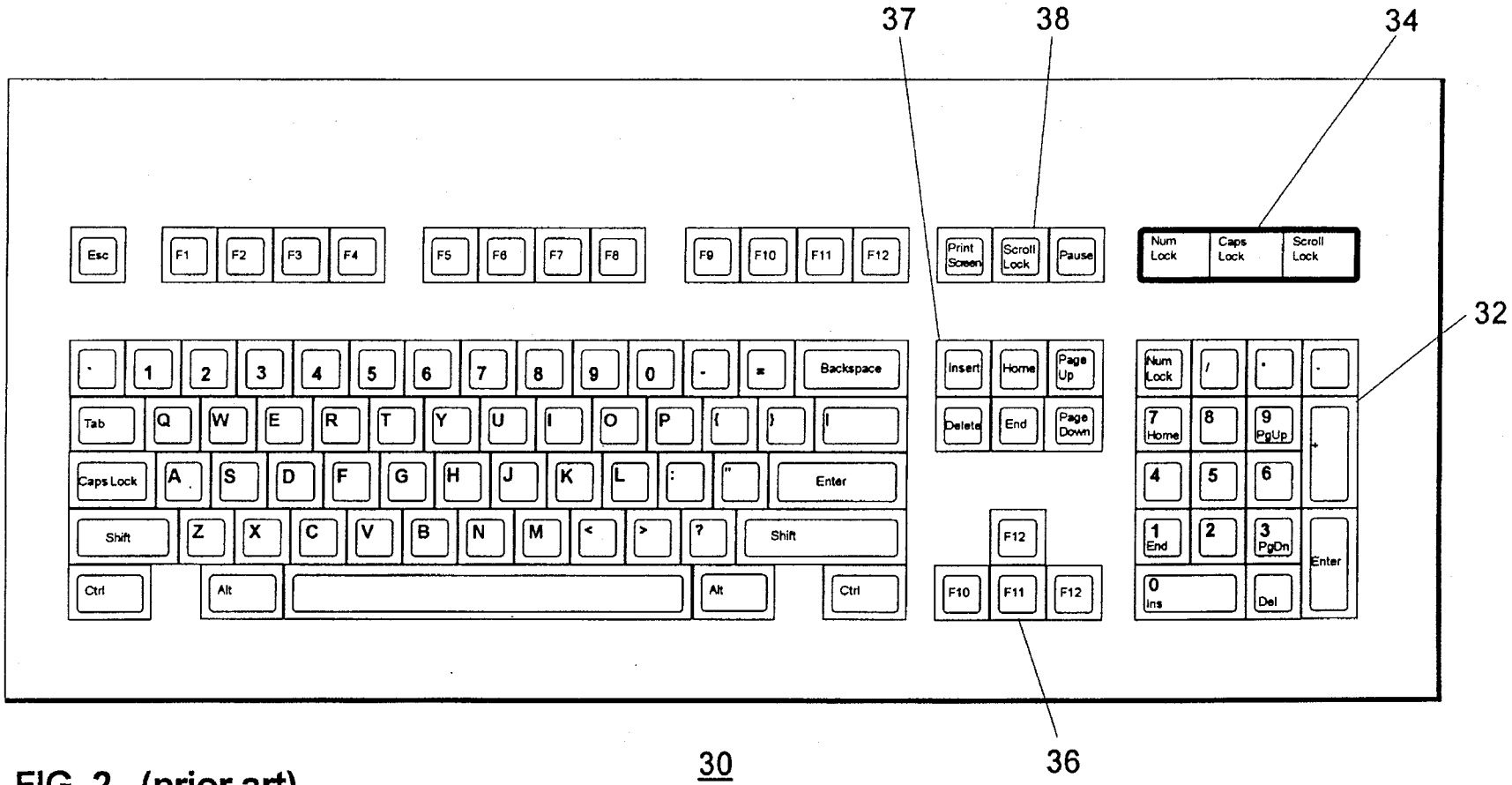
FIG. 2 (prior art)
FIG. 2 is a standard computer keyboard face.

FIG. 2 is a drawing of prior art, a standard 101-key computer keyboard 30 face. FIG. 1 is the children's computer keyboard 20 face of the present invention. The children's computer keyboard 20 has enlarged keys and a unique arrow-key pad.

Figure 3A:
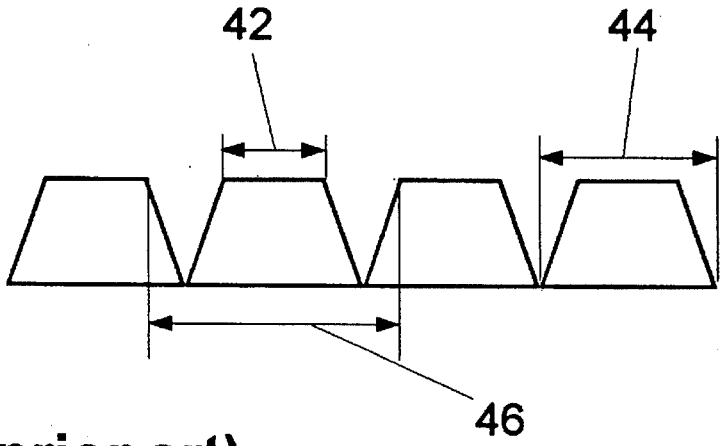
FIG. 3A (prior art) 40
FIG. 3A is a fragmentary longitudinal cross-sectional view of keys of a standard computer keyboard.
Figure 3B:
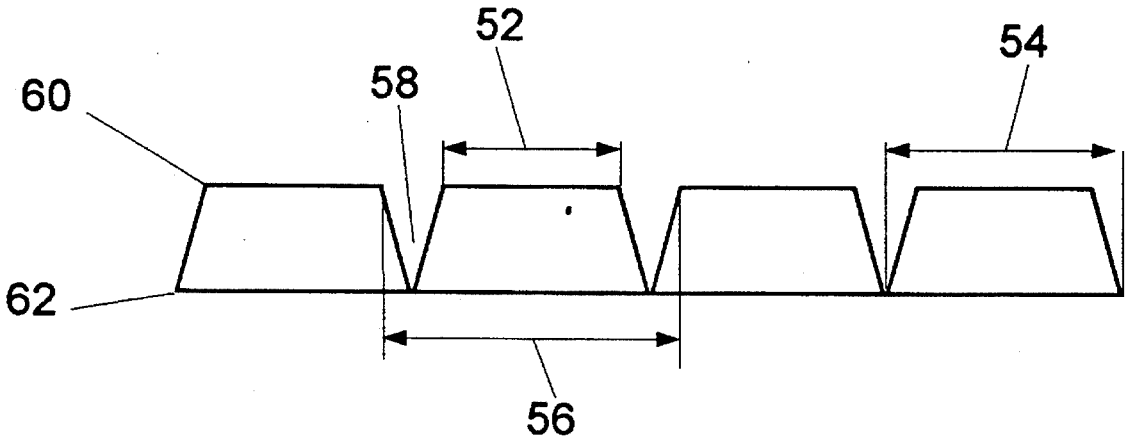
FIG. 3B is a fragmentary longitudinal cross-sectional view of keys of a children's computer keyboard according to the invention.

FIG. 3A is a drawing of prior art keys of a standard sized computer keyboard 30. FIG. 3B is a drawing of keys of the children's computer keyboard 20. As shown in the drawings, the keys of the children's computer keyboard 50 has enlarged base and top surface dimensions compare with the keys of a standard sized computer keyboard 40.

Figure 4A:
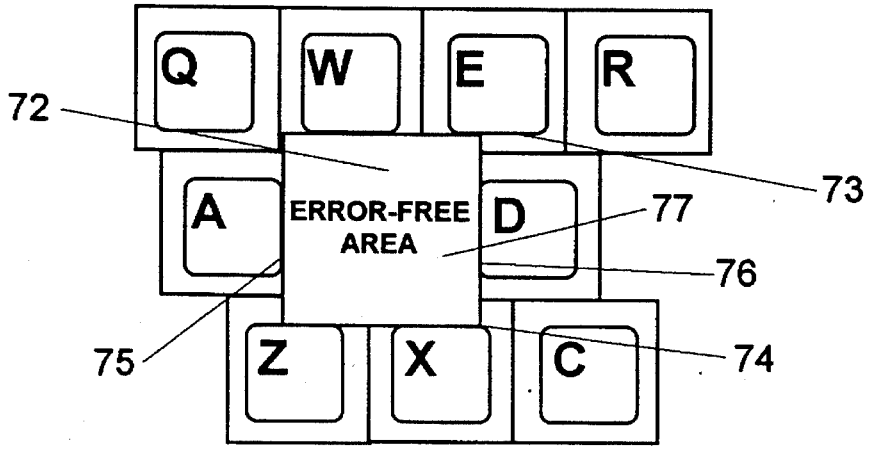
FIG. 4A (prior art) 70
FIG. 4A is a top plan view of keys of a standard computer keyboard showing error free area.
Figure 4B:
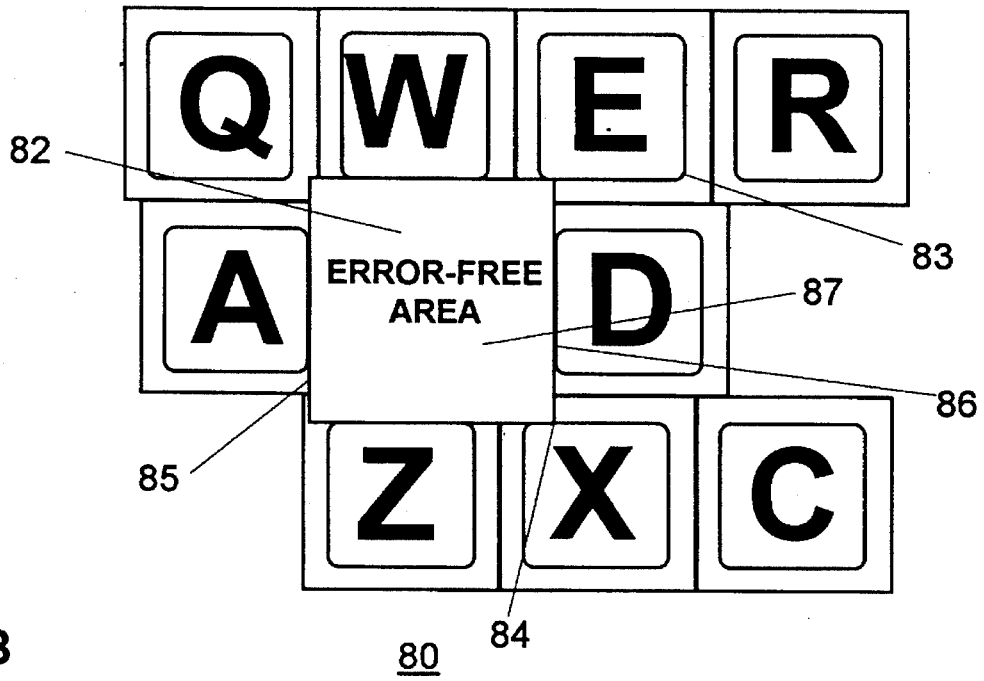
FIG. 4B is a top plan view of keys of a children's computer keyboard in accordance with present invention showing error free area.

FIG. 4A is a drawing of top plan view of prior art keys of a standard sized computer keyboard 30 showing an error-free area, which is to be defined later. FIG. 4B is a drawing of top plan view of keys of the children's computer keyboard 20 also showing an error-free area. The example shown on these two figures shows keys on the children's computer keyboard 80 have a bigger error free area 87 than the standard error free area 77 of a standard sized computer keyboard 70.

Figure 5A:
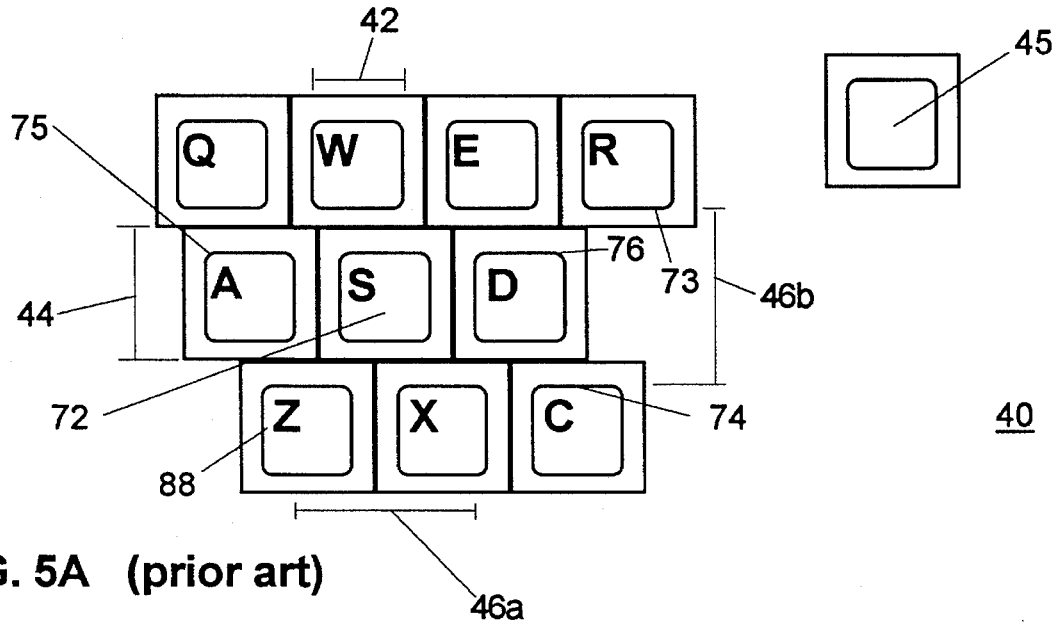
FIG. 5A (prior art)
FIG. 5A is a top plan view of keys of a standard computer keyboard.
Figure 5B:
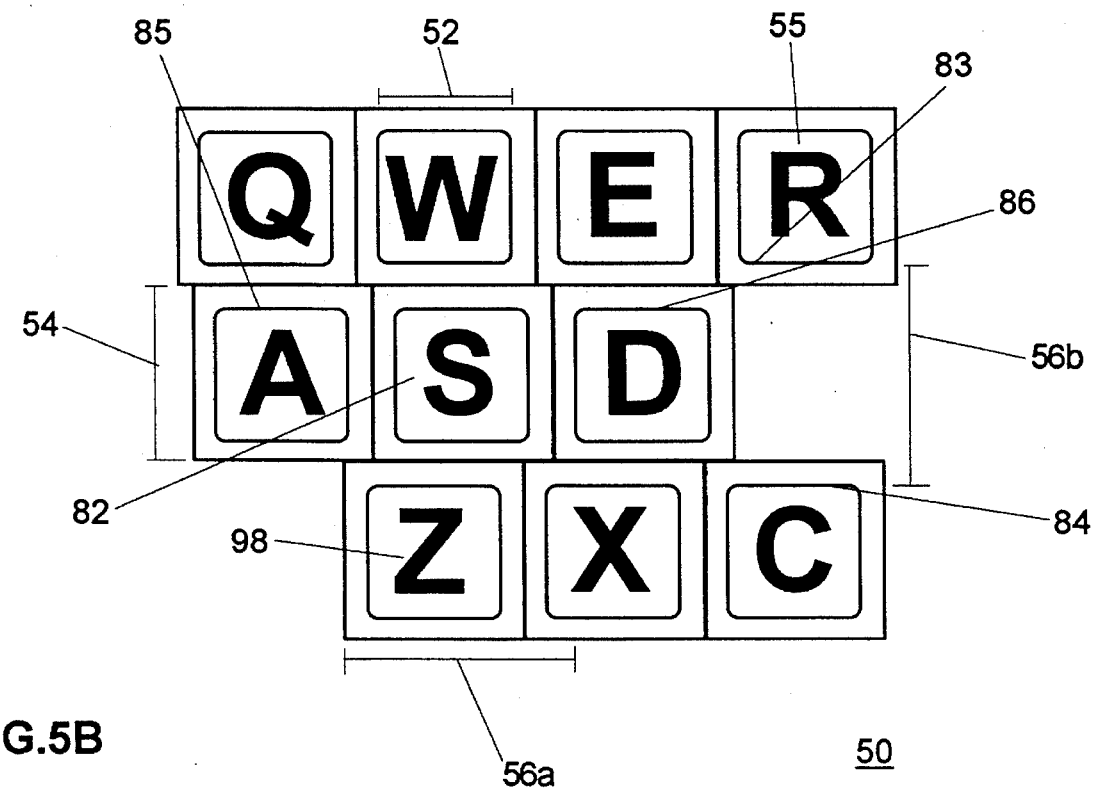
FIG. 5B is a top plan view of keys of a children's computer keyboard according to the invention.

FIG. 5A is a drawing of top plan view of prior art keys of a standard sized computer keyboard 30 showing the top surface of typing area 45 of the keys and characters 72 on the keys. FIG. 5B is a drawing to the same relative scale of top plan view of keys of the children's computer keyboard 20, also showing typing area 55 of the keys and characters 82 on the keys. The example shown on these two drawings shows the characters 82 on the children's computer keyboard 40 are much larger than the characters 72 on the standard sized computer keyboard 50.

QWERTY KEYBOARD LAYOUT

The children's computer keyboard described in this invention utilizes the traditional QWERTY keyboard layout. FIG. 1 shows the face of the children's computer keyboard 20. When young children use this keyboard, they will have the opportunity to learn the relative position of the keys on a traditional keyboard with QWERTY layout. By the time they are old enough to learn to type, they will already be familiar with the relative location of each key on a keyboard with QWERTY layout.

Kid Keys invented by Jerry Wagstrom of Huntersville, N.C., also utilizes oversized keys. However, the keyboard layout in Kid Keys are arranged in alphabetical order, not in standard QWERTY keyboard layout. The layout in Kid Keys may be easier for children to use at the beginning. However, they will have to relearn the QWERTY layout when they are old enough to learn how to type. The keyboard layout in the present invention allows the children to learn the standard QWERTY keyboard layout from day one. The young children use the children's computer keyboard 20 in their early days playing with computer would have already been familiar with the QWERTY keyboard layout when they are ready to learn how to type on a traditional standard sized keyboard 30.

The children's computer keyboard 20 described in the present invention has a footprint size of 21.75"×8.5" of the outside dimension of the keyboard. The standard computer keyboard 30 has a smaller footprint size at 19"×7.375".

One of the advantages of using a computer system equipped with a children's computer keyboard 20 is that adults can also use it. Although the size of the keys on the children's computer keyboard 20 is bigger than the keys on a standard sized keyboard 30 and may seem awkward at the beginning, it, nevertheless, retains the standard QWERTY keyboard layout. An adult can sit down and start typing on the children's computer keyboard 20 the same way they would type on a standard sized keyboard 30. There is no need to switch to a standard sized keyboard 30 for an adult user.

SIZE OF KEYS

The children's computer keyboard 20 described in this invention has bigger keys than those of the traditional standard sized keyboard 30. FIG. 2 shows a standard sized 101-key keyboard 30. When young children are using this standard sized keyboard 30, they are more likely to hit the wrong key. This is because the keys on the standard sized keyboard 30 are made for efficient typing by adult or teenaged users. Therefore, they are smaller and less tolerant for errors. Had the children users used the children's computer keyboard described in the present invention, they would have had higher rate of success in hitting the correct keys.

The children's computer keyboard 20 has enlarged keys.

The children's computer keyboard 20 gains the spaces it needed for the enlarged keys by eliminating the numerical keypad 32 and LED indicators 34 on the standard sized 101-key keyboard 30. The numerical keypad 32 is most useful for accounting or data entry personnel. Since the targeted user of this children's computer keyboard 20 is primarily for children, and not for professional personnel, the numerical keypad 32 is therefore eliminated for better usage of the space occupied by it.

The children's computer keyboard 20 also gains extra space by eliminating a standard three-key set 38, each key has the function of Print Screen/SysRq, Scroll Lock, and Pause/Break respectively. A standard six-key set 37 on the standard sized 101-key keyboard 30, each key has the function of Insert, Delete, Home, End, Page Up, and Page Down respectively, is replaced by a children's larger six-key set 27 positioned at the upper right corner of the children's computer keyboard 20.

Viewing from the top surface of the keyboard, the keys on a standard sized keyboard 30 are mostly square shaped, while some are rectangle shaped. As illustrated in FIG. 3A and FIG. 5A, each side of a square key of the standard sized keyboard 40 has a top surface dimension 42 of 0.54", and a base dimension 44 of 0.75". The keys in the children's computer keyboard 20 are also mostly square shaped viewing from the top surface of the keyboard, while some are also rectangular in shape. However, as illustrated in FIG. 3B and FIG. 5B, the top surface dimension 52 of a square key on a children's computer keyboard 50 is 0.875", and base dimension 54 is 1.125". This gives the standard top surface area 45 of 0.25 square inch for the keys on a standard sized keyboard 30, and children's top surface area 55 of 0.77 square inch for the keys on a children's computer keyboard 20. Therefore, the keys in the present invention have more than tripled the top surface area 55 compared to that of keys on a standard sized keyboard 30.

ERROR FREE ZONE AND ERROR FREE AREA

The enlarged keys of children's computer keyboard 20 described in this invention are more tolerant to potential mistakes made by the user as they have a bigger error free zone and larger error free area. The more tolerant the keys are to mistakes, the less time the user will spend on correcting the mistakes, and the use will be less frustrated. Therefore, he or she can spend more time in learning and playing on a computer, and will be more motivated to do so.

A typical square shaped key of the children's computer keyboard 20 would have a children's error free zone 56, which is the distance between the two closer edges of the top surfaces of two opposite sided neighboring keys to that key. The horizontal distance between two neighboring keys, that is the right top surface edge of the key to the left of that key and the left top surface edge of the key to the right of that key, is the horizontal error free zone. The vertical distance between two neighboring keys, that is the lower top surface edge of the key above that key and the upper top surface edge of the key below that key, is the vertical error free zone. For example, as illustrated in FIG. 4B and FIG. 5B, the children's error free zone of the "D" key 82 is the distance between the lower edge of the top surface of "R" key 83 and the upper edge of the top surface of "C" key 84, which is the vertical error free zone 56*b;* or the distance between the right edge of the top surface of "S" key 85 and the left edge of the top surface of "F" key 86, that is the horizontal error free zone 56*a*.

The area covered by the children's horizontal error free zone 56*a* and vertical error free zone 56*b* is the children's error free area 87, the shaded area as shown in FIG. 4B. The children's error free area 87 is the tolerance area before an error, by hitting a wrong key, is made.

The standard error free zone 46 (46*a* and 46*b*) of a key of a standard sized keyboard 30 has the dimension of 1", while the error free zone 56 (56*a* and 56*b*) of the present invention is 1.375". Therefore, the standard tolerance area or the standard error free area 77, the shaded area of keys of a standard sized keyboard 70 as shown in FIG. 4A, of a key of a standard sized keyboard is 1 square inch. The children's tolerance area or the children's error free area 87 of a key on the present invention is 1.89 square inch, a net increase of tolerance area of more than 89%. The bigger the children's error free area 87, the more tolerant it is for potential mistake and therefore, easier to use.

The increases in the tolerance area or error free area 87 in the keys of children's computer keyboard 20 increases the chance of entering the correct keys, thus make the typing more effective. The user can spend more time doing the things they intend to do rather and not wasting their time in making corrections.

LARGER CHARACTERS ON KEYS

The keys of a standard sized keyboard 30 has smaller standard characters 88 positioned on the upper left corner surface of the key, while the children's characters 98 of the present invention 90 are bigger than the standard characters 88. This is because the children's top surface area 55 of a square shaped key of a children's computer keyboard 20 is 0.77 square inch. This is more than three times bigger than that of a square shaped key of a standard sized keyboard 30, which is 0.25 square inch. Therefore, keys on the children's computer keyboard 20 can afford to be equipped with larger characters on them.

ARROW-KEY PAD

Figure 6:
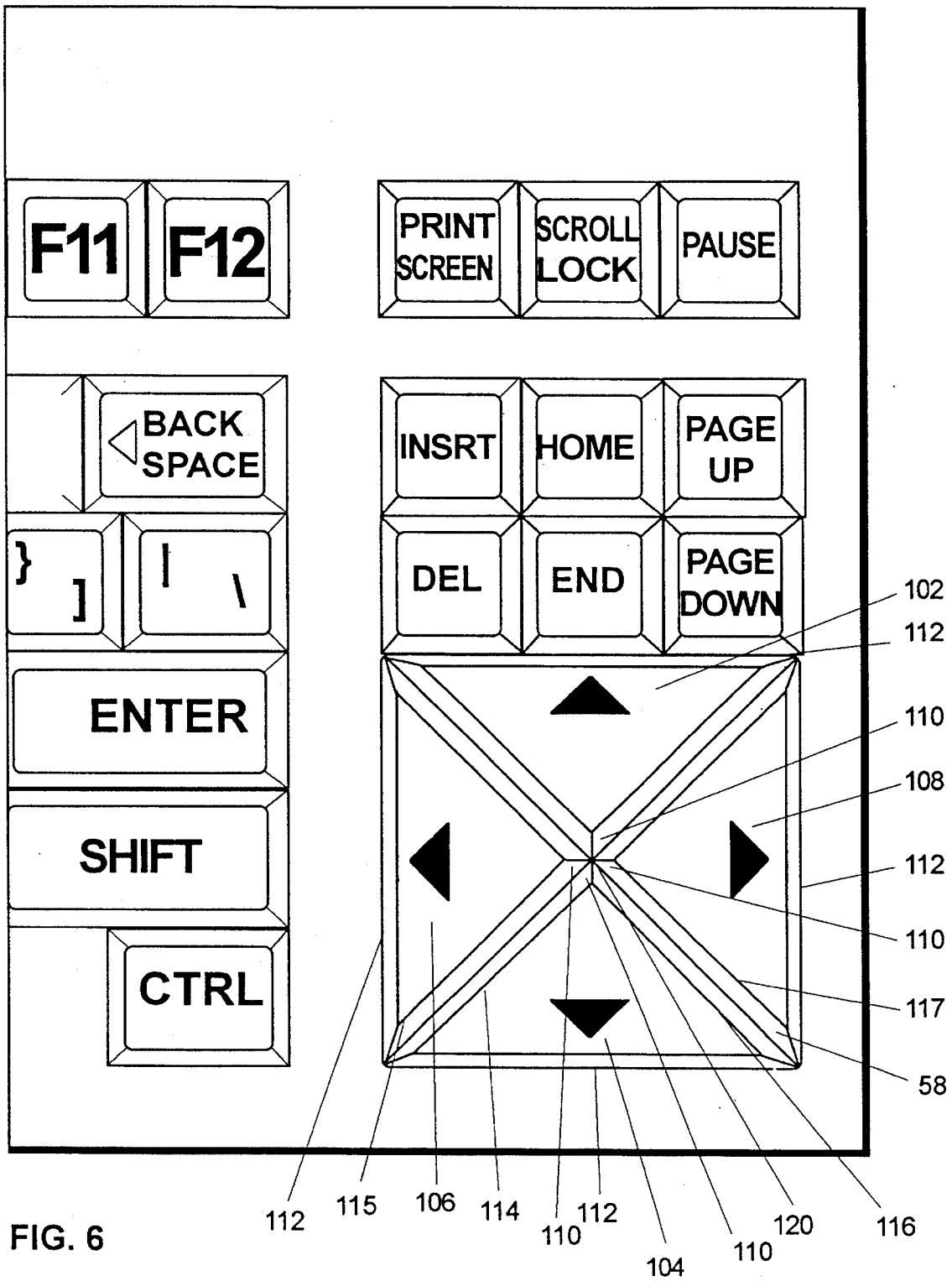
FIG. 6 is a fragmentary top plan view of keys of a children's computer keyboard with emphasis on the arrow-key pad.
Figure 7:
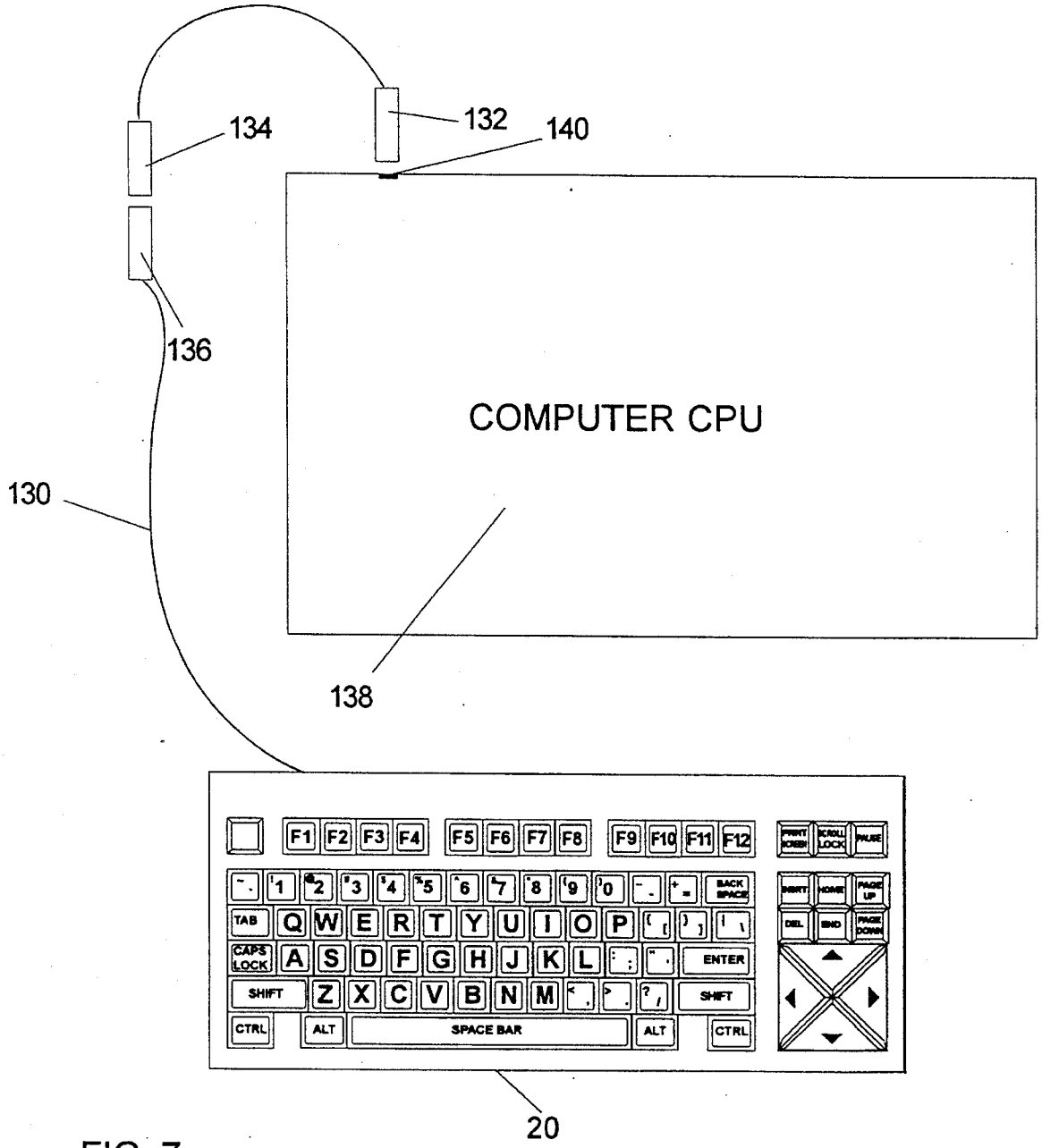
FIG. 7 is a schematic diagram of a computer system equipped with a keyboard adaptor cord in accordance with the invention.

The standard arrow-key set 36 on the standard sized keyboard 30 is replaced by a children's arrow-key pad 22 on the children's computer keyboard 20. The children's arrow-key pad 22 comprises an up-arrow key 102, a down-arrow key 104, a left-arrow key 106, and a right arrow key 108 as shown in FIG. 6.

Each of the arrow keys of the children's arrow-key pad 22 on the children's computer keyboard 20 is a right-angled isosceles triangular shaped key. The apices 110 of each triangular shaped arrow-key meet in the center 120 of the children's arrow-key pad 22 on the same plan. Each of the arrow keys is congruent to other arrow keys in the children's arrow-key pad 22. The children's arrow-key pad 22 is square in shape, where the hypotenuse 112 of each triangular shaped arrow key forms a side of the square. Each leg of each arrow key is next to the leg of a neighboring arrow key. For example, one leg 114 of the down-arrow key 104 is next to a leg 115 of the left-arrow key 106, and the other leg 116 of the down-arrow key 104 is next to a leg 117 of the right-arrow key 108.

OPERATING THE ARROW KEYS

The keys are tapered out from the top surface 60 to the base 62, an opening 58 is formed between the top surfaces of neighboring keys while the base 62 of a key is adjacent to the base 62 of a neighboring key. The arrow-key pad 22 is arranged in such a way that it is easy to operate. The arrow-key pad is at least three fingers wide so that the user can easily put three fingers on the arrow-key pad 22 when operating it. The user may put his or her right middle finger in the opening of the four arrow keys, that is approximately where the center 120 of the arrow-key pad 22 is; put the right index finger on the left arrow key 106 and right ring finger on the right arrow key 108; and maneuver the right middle finger to access either the up arrow key 102 or down arrow key 104 respectively. When entering the left arrow key, the user simply pushes his or her right index finger down. When entering the right arrow key, the user simply pushes his or her right ring finger down. When entering the up arrow key, the user simply moves his or her right middle finger up, then pushes it down and returns to the center of the arrow-key pad. When entering the down arrow key, the user simply moves his moves his or her right middle finger down then pushes it down and returns to the center of the arrow-key pad.

KEYBOARD ADAPTOR/EXTENSION CORD

The present invention also incorporates a keyboard adaptor cord 130 for the convenience of the users to change their computer keyboards. Most computers are designed with the keyboard connector at the rear of the computer, which is fine if the user plans to leave the keyboard connected most of the time. However, if the user needs to change keyboards from time to time, then disconnecting and reconnecting the keyboard can become a burdensome activity. Especially with a tower computer, the main system equipped with the keyboard connector is usually placed under a table or desk. Under this circumstance switching the keyboard may become very annoying. All these inconveniences were caused by the location where the change has to take place. The keyboard adaptor cord described in the present invention solves this problem by giving the user the convenience of changing the keyboards while remain sitting in his or her chair.

Since the children's computer keyboard 20 has the standard QWERTY layout, adults can also use it. The parents need not keep a standard sized QWERTY computer keyboard 30 for their own use and buy a special keyboard for the children to use. The parents can use the keyboard described in the present invention for their use as well.

However, if the parents decide to keep a standard sized keyboard 30 for their own use and a children's computer keyboard 20 for the children to use, they may find switching the keyboard cable behind the computer system an annoying task. Especially if the parents have to crawl in and out under the desk or computer table to do that. Therefore, it would be convenient if the users can switch the keyboard while sitting in their chair. This can be accomplished by connecting an adaptor or extension cord 130 between the computer system 138 and the keyboard 20. The user can affix one end of the adaptor cord 130 to the computer system 138 and the other end to the keyboard 20. To switch keyboards, the user simply disconnect or connect the keyboard connector 136 to the connector of adaptor cord 134.

The keyboard adaptor cord 130 comprises a male jack 132 having a plurality of pins and a female jack 134 having a plurality of pins. The two jacks are connected through a cord having a plurality of conductors functionally similar to the cord used in a computer keyboard. Ordinarily, without this adaptor cord 130, user would connect his or her keyboard to system's female jack 140 on the computer system 138 with a keyboard male connector 136 on the keyboard. In a computer system equipped with this adaptor cord 130, the user connects the cord male jack 132 to the system female jack 140; on the other end of the keyboard adaptor cord 130, the user connects the cord female jack 134 to the keyboard male jack 136.

In most conventional computer systems, the system female jack 140 is installed at the rear panel of the computer system 138. The user will have to reach to the back of the computer system 138 to be able to change the keyboard. However, in a system equipped with this adaptor cord 130, the cord male jack 132 is connected to the system female jack 140, while the cord female jack 134 is to be connected to the keyboard male jack 136. Therefore, the user only needs to connect or disconnect the keyboard male jack 136 to or from the cord female jack 134, which may be readily accessible by the user without reaching to the back of the computer system 138.

The adaptor cord 130 described here can also be used as an keyboard extension cord.

The invention has been described with reference to be used in a computer system, but it will be appreciated that it may be applied to many other applications where it may be advantageous to be used.

What I claim is:

1. A computer keyboard for a computer system comprising:

a cursor control arrangement comprising an arrow-key pad device formed with four arrow-keys wherein a) said four arrow-keys each being a right-angled isosolecs triangular shaped key placed on a plane of the computer keyboard to form a square shaped arrow-key pad;

b) the apex of one of the four arrow-keys being side by side with the apices of two other arrow-keys and opposite to the apex of a fourth arrow-key, whereby the apices meet at the center of the square shaped arrow-key pad;

c) the hypotenuse of each triangular shaped arrow-key forming a side of the square shaped arrow-key pad;

d) the hypotenuse of a down arrow-key forming a lower side of the arrow-key pad, the hypotenuse of a left arrow-key forming a left side of the arrow-key pad, the hypotenuse of an up arrow-key forming a top side of the arrow-key pad, and the hypotenuse of a right arrow-key forming a right side of the arrow-key pad;

said computer keyboard further comprising a numerical key group, an alphabetic key group, a function key group, and a punctuation key group, each of said groups of keys being a different color.

2. The computer keyboard of claim 1, wherein said groups of keys have enlarged top surfaces relative to those of a standard keyboard.

3. The computer keyboard of claim 2, wherein the alphabetic key group is arranged in a QWERTY layout.

4. The arrow-key pad of claim 1 which is at least three finger widths, whereby for right-hand operation by a user, the right middle finger of the user's hand is placed at the center of the arrow-key pad, the right index finger on the left arrow key, and the right ring finger on the right arrow key:

the right index finger of the user may enter the left arrow key;

the right ring finger of the user may enter the right arrow key; and either the up arrow key or the down arrow key may be entered with the right middle finger of the user by maneuvering the user's right middle finger up or down.

5. A computer keyboard as in claim 1, further comprising a connecting device connected to the computer keyboard, said connecting device comprising:

a) a first cord jack having a plurality of pins that may be connected to a system jack on the computer system;

b) a second cord jack having a plurality of pins that may be connected to a keyboard jack on the computer keyboard; and c) separable parts respectively connecting the first cord jack and the second cord jack.

* * * * *